US005653368A

United States Patent [19]

Miles et al.

[11] Patent Number: 5,653,368

[45] Date of Patent: Aug. 5, 1997

[54] FASTENER INSTALLATION APPARATUS

[75] Inventors: Michael Miles, Stevenage; Stephen Richard Tarling, Harpenden, both of England

[73] Assignee: Avdel Limited, Hertfordshire, England

[21] Appl. No.: 35,189

[22] Filed: Apr. 7, 1987

[30] Foreign Application Priority Data

Apr. 11, 1986 [GB] United Kingdom ..... 8608817

[51] Int. Cl.[6] ..... B21J 15/28

[52] U.S. Cl. ..... 227/2; 227/112; 227/135; 72/18.9; 29/243.525; 29/243.53; 29/812.5

[58] Field of Search ..... 227/2, 112, 135, 227/119; 29/243.525, 243.53, 812.5; 72/18.9, 21.6, 453.17

[56] References Cited

U.S. PATENT DOCUMENTS

| | | | |
|---|---|---|---|
| 3,222,577 | 12/1965 | Kennedy . | |
| 3,367,166 | 2/1968 | Newton et al. | 72/391 |
| 3,461,353 | 8/1969 | Thorson . | |
| 4,062,217 | 12/1977 | Ebbert et al. | 72/391 |
| 4,266,905 | 5/1981 | Birk et al. . | |
| 4,281,531 | 8/1981 | Ehmann et al. | 72/391 |
| 4,612,538 | 9/1986 | Karcher, Jr. . | |
| 4,627,785 | 12/1986 | Montforte . | |
| 4,683,654 | 8/1987 | Scholten et al. . | |

OTHER PUBLICATIONS

POP Rivet Fastening Systems Catalog and Handbook (Dec. 1988).

"Machine Design", advertisement (1 page) (Jan. 6, 1983).

"Fastec 85". pp. 1, 4–12 to 4–21 (Oct. 8–11, 1985).

"Data Precima Eng. Data Sheet" (Cable declaration), 2 pp. (Feb. 1, 1983).

A.E. DiMaio, "Portable and Automated Blind Riveting Systems", undated article.

"Western Electric Technical Digest", pp. 3–4 (Oct., 1975).

USN Fastener Group Ad Sheet, 2 pp. (Jun. 1977).

"Tucker POPmatic", 6 pp. (Jun. 1986).

*Primary Examiner*—Scott A. Smith

*Attorney, Agent, or Firm*—Oblon, Spivak, McClelland, Maier & Neustadt, P.C.

[57] ABSTRACT

Fastener installation apparatus for operating cyclically so as to instal successively a plurality of fasteners includes a fastener installation head (11) having an aperture (35) in which part of a fastener is inserted, and a vacuum generator (20) for creating an airflow in through the aperture (35), along a pipe (31) and into a receptacle (15) for broken-off fastener parts. The presence of a fastener in the aperture (35) causes a change in the level of vacuum in the pipe (31) and receptacle (15). The level of vacuum is sensed by vacuum level detection means (45), which gives an electrical signal to the apparatus control unit (14*a*, 14*b*). The control unit allows the installation apparatus to continue its cyclical operation only upon the presence or absence of fastener in the aperture (35) at the appropriate points in the cycle of operation of the apparatus.

29 Claims, 4 Drawing Sheets

FASTENER INSTALLATION APPARATUS

BACKGROUND OF THE INVENTION

The invention relates to fastener installation apparatus. More particularly it relates to such apparatus which includes an aperture into which part of a fastener to be installed thereby is inserted.

Whereas in the past such fastener installation apparatus (e.g. for installing breakstem rivets) has normally been hand-held by an operator who actuated it and inserted new fasteners one at a time into the apparatus, there is now a requirement for such apparatus to operate cyclically and without direct supervision by an operator, so as to instal a plurality of fasteners successively and automatically. Such apparatus is usually arranged to feed new fasteners successively to the fastener installation head, and to remove broken-off portions of fasteners therefrom. In order to enable the apparatus to work automatically without jamming, because of e.g. the misfeed of a new fastener to the installation head, or a broken-off portion not being completely and properly removed therefrom, it is necessary that the correct operation of various parts of the apparatus is monitored and checked automatically.

SUMMARY OF THE INVENTION

The present invention seeks to facilitate such functions.

Accordingly, the invention also provides fastener installation apparatus for installing fasteners, which apparatus comprises:—fastener installation means including an aperture into which part of a fastener to be installed thereby is inserted; vacuum means, connected to the aperture, for drawing air in through the aperture; and vacuum level detection means for detecting whether the level of vacuum corresponds to the presence of a fastener in the aperture of the installation means.

Preferably the flow of air drawn in through the aperture by the vacuum means is used to remove from the fastener installation means portions of fasteners which are broken off at the installation of the fastener. Preferably the apparatus includes a receptacle in which broken-off fastener portions are deposited by the airflow. Preferably the vacuum means draws air out of the receptacle and thus in through the aperture as aforesaid. Preferably the vacuum level detection means is connected to the receptacle to detect the level of vacuum therein. Preferably the vacuum level detection means is connected to the receptacle via the vacuum means. Alternatively, where the apparatus includes a passage connecting the aperture to the vacuum means, preferably the vacuum level detection means is connected to the passage adjacent the aperture the aperture, to detect the level of vacuum in the passage adjacent the apparatus. Where the apparatus is arranged to operate cyclically so as to instal a plurality of fasteners successively, prefereably it includes control means operative to allow the cyclical operation of the apparatus to continue, so as to instal a fastener, only upon the vacuum level detection means detecting a level of vacuum corresponding to the presence of the fastener in the aperture of the fastener installation means. Preferably the apparatus includes resetting means for resetting the vacuum level detection means, after the latter has detected the presence of a fastener in the aperture, to a state in which it is ready to detect the presence of a further fastener in the aperture, the resetting means being actuated to reset the vacuum level detection means by a signal indicating that the fastener which was in the aperture is no longer there.

Where the apparatus also includes conveying means for conveying away from the fastener installation means a portion of a fastener which is broken off at the installation of the fastener, and portion detection means for detecting when a broken-off portion has reached a pre-determined position on its formerly along the conveying means, preferably the resetting means is actuated to reset the vacuum level detection means only upon, at least, the aforesaid broken-off portion detection means detecting the presence at the aforesaid pre-determined position of the broken-off portion of the previously installed fastener.

The invention also provides fastener installation apparatus adapted to operate cyclically so as to instal successively a plurality of fasteners each having a portion which is broken-off at installation, which apparatus comprises:—fastener installation means for installing a fastener and thereby producing a broken-off portion, the fastener installation means including an aperture into which part of the fastener is inserted; conveying means for conveying the broken-off portion away from the installation means; portion detection means for detecting when the broken-off portion has reached a pre-determined position on its journey along the conveying means; vacuum means, connected to the aperture, for drawing air in through the aperture; vacuum level detection means for detecting whether the level of vacuum corresponds to the presence of a fastener in the aperture; control means operative to allow the cyclical operation of the apparatus to continue, so as to instal a fastener, only upon the vacuum level detection means detecting a level of vacuum corresponding to the presence of the fastener in the aperture of the fastener installation means; and resetting means for resetting the vacuum level detecting means after the latter has detected the presence of a fastener in the aperture, to a state in which it is ready to detect the presence of a further fastener in the aperture, the resetting means being actuated to reset the vacuum level detection means only upon, at least, the broken-off portion detection means detecting the presence at the aforesaid pre-determined position of the broken-off portion of the previously installed fastener.

BRIEF DESCRIPTION OF THE DRAWINGS

A specific embodiment of the invention will now be described by way of example and with reference to the accompanying drawings, in which.

DETAILED DESCRIPTION OF THE PREFERRED EMBODIMENTS

Figure 1:
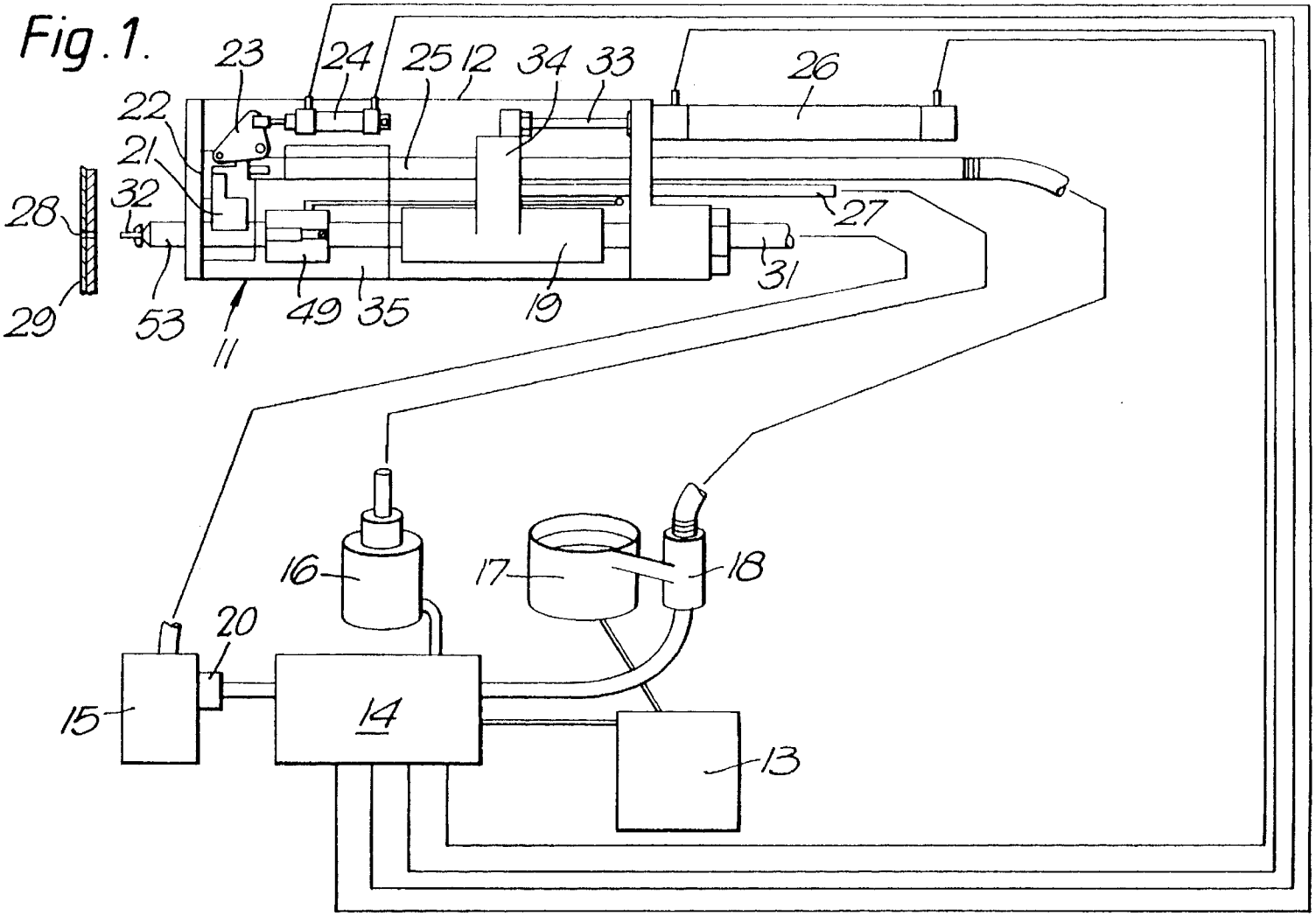
FIG. 1 shows schematically an automatic blind-rivet installation system before the application to it of the present invention.
Figure 4:
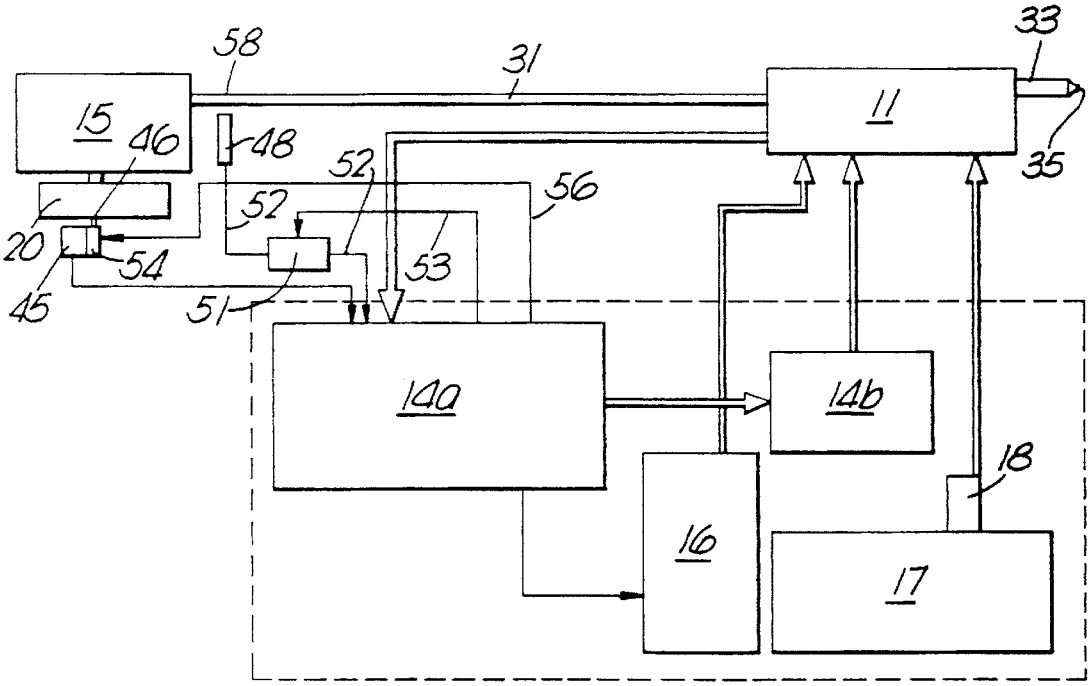
FIG. 4 is a schematic block diagram of the system incorporating the present invention.

Referring first to FIG. 1, a system for automatically and repetitively installing blind breakstem rivets comprises installation apparatus 11 which is built within a rigid frame 12. The system is powered and operated by pneumatic and pneumatic/hydraulic means. To this end it comprises a pneumatic pressure source 13, electronic/pneumatic sequence controller 14, vacuum generator 20 and rivet stem receptacle 15, pneumatic/hydraulic intensifier 16 to power the hydraulically operated rivet installation head, rivet bowl feeder 17 and single rivet feeder 18. The units 11, 16 and 18 and 20 are connected to and controlled by the sequence controller 14 so as to feed new rivets one at a time to the installation apparatus 11 and to control its operation in the way which will be described later. The controller 14 comprises a programmable electronic logic unit 14*a* and a pneumatic valve unit 14*b*. (FIG. 4).

The installation apparatus 11 includes a reciprocable rivet installation head 19. New rivets are fed in front of it, one at a time, when it is in its rearward position, by means of rivet feeding means comprising rivet supporting means 21 which is movable transversely on a slide 22 actuated through a bell-crank 23 by a double-acting pneumatic actuator 24, controlled by the sequencer 14. New rivets from the single feeder 18 are blown one at a time into a feed tube 25, from the front end of which the rivet supporting means 21 transfers one rivet at a time to a pick-up position in front of the installation head 19. The installation head 19 is reciprocated axially by a double-acting pneumatic actuator 26, controlled by the sequencer 14. The installation head 19 includes within it a hydraulic actuator, fed by a hydraulic pipe 27 from the intensifier 16 which is controlled by the sequencer 14. When the pneumatic actuator 24 is operated, it causes jaws 38 (FIG. 2) within the installation head 19 to grip a rivet stem 36 and pull it, thus deforming the rivet body. After each rivet 32 has been installed in a hole such as 28 in a workpiece 29, the part of the stem 36 which has been gripped and pulled by the jaws 38 is broken off from the remainder of the rivet 32, and is then released by the jaws, from where it travels rearwardly down a stem extractor pipe 31, into the stem receptacle 15, due to the suction created by the vacuum generator 20.

Figure 2:
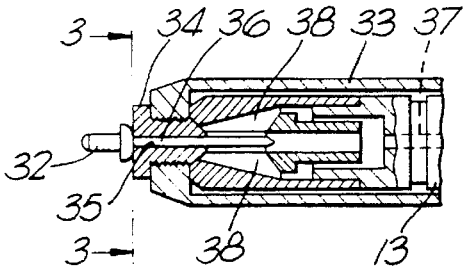
FIG. 2 is an axial section through the front end of the installation head.
Figure 3:
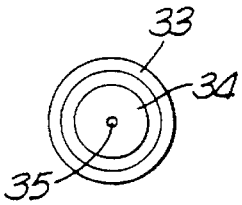
FIG. 3 is an end elevation of the front end of the head, on the line 3—3 of FIG. 2.

The front part of the rivet installation head 19 is shown in FIGS. 2 and 3 and comprises a cylindrical barrel 33 having at its front end an annular steel anvil 34 formed with a central aperture 35. Into this aperture 35 is inserted the stem 36 of each rivet 32. The stem 36 is a fairly close fit in the aperture 35, and the vacuum applied to the aperture 35, through the stem receptacle 15, stem extractor pipe 31 and an axial passage 37 through the installation head 19, assists in retaining the rivet 32 on the anvil 34 until it is installed. After each rivet 32 has been installed, a further rivet 32 is fed to the installation head 19 by the rivet feeding means.

The use of an electronic/pneumatic sequencer such as 14 for automatically controlling the various elements of the system is well understood and will not be described further. In the following description it will be assumed that the operation of various elements of the system, and the various elements of the installation apparatus 11 in particular, are operated at the appropriate times by the sequencer 14.

The installation system is intended to operate cyclically, to instal rivets successively. Each cycle may be initiated by a suitable signal fed to the sequence controller 14.

As previously explained, it is necessary for the safe and proper operation of the system that operation is allowed to continue to the next stage only if the previous stage is complete. If it is not, operation of the system should stop immediately. Thus, the installation head 19 should be actuated to instal a rivet only if a rivet 32 is present in the aperture 35. The present applicants have appreciated that the presence of a rivet 32 in this position effectively seals the aperture 35 against air entering it. Since the vacuum generator 20 runs continuously, when a rivet 32 is in position in the aperture 35, the level of vacuum increases within the stem receptacle 15. Consequently, detecting the level of vacuum in the receptacle 15 detects whether or not there is a rivet 32 in the aperture 35.

Since, when the installation of each rivet 32 is complete, the stem breaks 36 off and is conveyed away from the installation head 19, along the pipe 31 towards and into the receptacle 15, detection of the presence of a broken off stem at a position along the pipe 31 will indicate that the rivet 32 has been installed.

Figure 5:
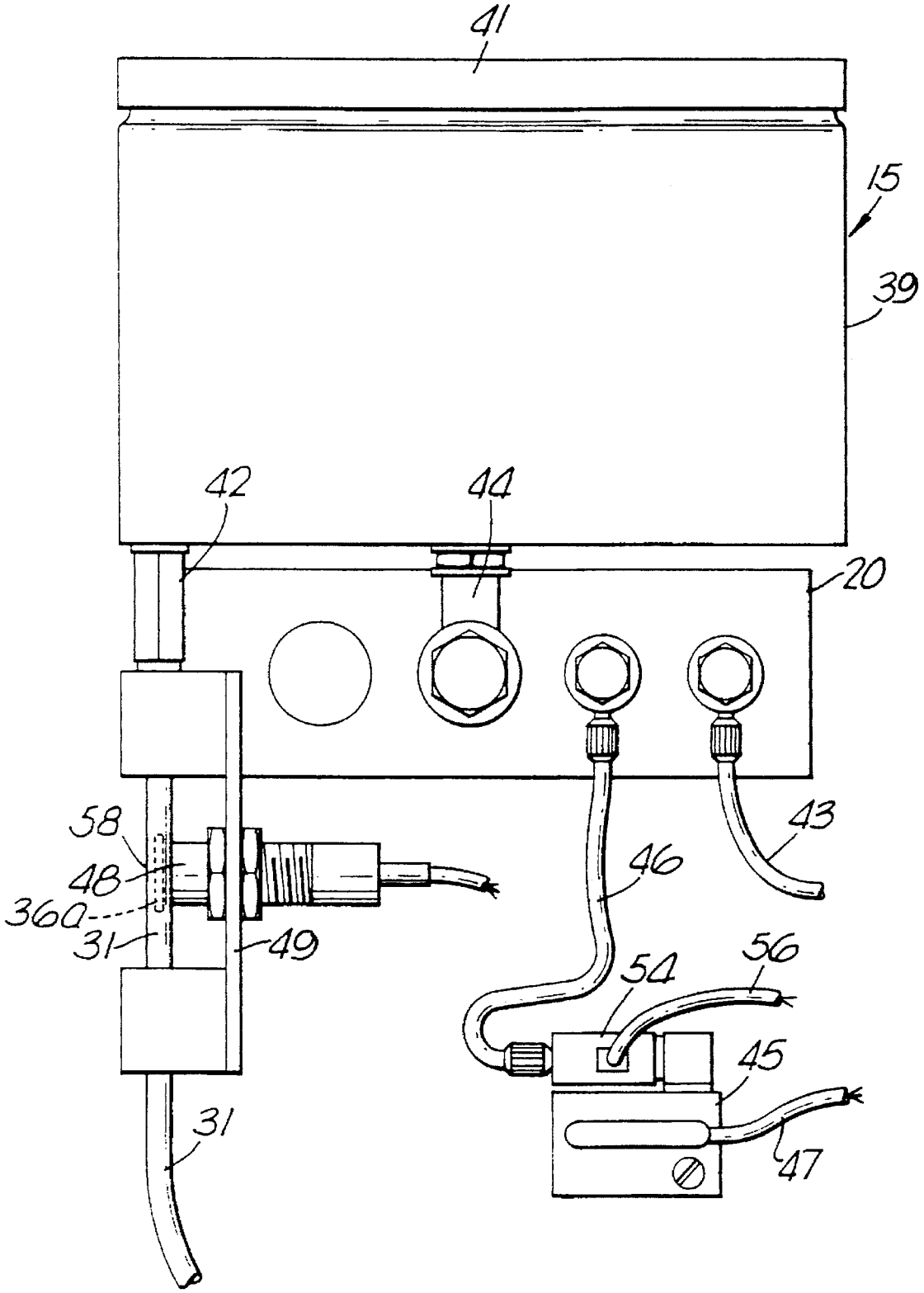
FIG. 5 is a plan view of part of the system.
Figure 6:
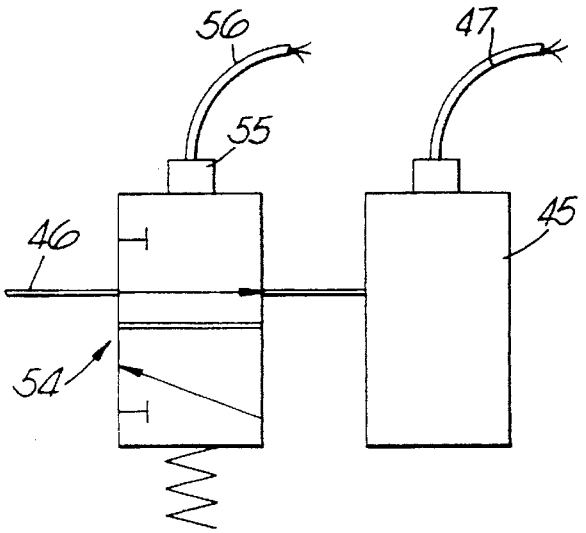
FIG. 6 illustrates schematically the resetting means for resetting the vacuum-sensitive means.

The means for detecting such vacuum level and stem presence will now be described with reference to FIGS. 4, 5 and 6.

The stem receptacle 15 comprises a metal box 39 with a removable side wall 41 for emptying stems 36 out of the box 39. The side wall 41 seals the box 39 against air entry. The stem extractor pipe 31 (which consists of a flexible synthetic plastics hose) enters the opposite side of the box through a coupling sleeve 42.

The vacuum generator 20 is of the venturi type which is fed with compressed air through a supply pipe 43. The vacuum side of the generator 20 is connected into the receptacle 15 through a rigid connection 44. The vacuum generator 20 runs continuously and exhausts the receptacle 15 and the stem extractor pipe 31. The other end of the pipe 31 is connected to the passage 37 through the installation head 19, and thus to the aperture 35.

The level of vacuum in the receptacle 15 is detected by a vacuum-sensitive switch 45. This is connected via an air tube 46, through the vacuum generator 20, to respond to the level of vacuum. The level of vacuum in the vacuum generator 20 which is thus sensed is substantially the same as the level of vacuum in the receptacle 15. Alternatively the vacuum sensitive switch could be connected to the receptacle 15 itself, or to a convenient position on the stem extractor pipe 31. In this example apparatus, the vacuum switch 45 is of the movable-diaphragm type, in which the position of the diaphragm controls the opening or closing of two electrical contracts. When the level of vacuum within the receptacle 15 is sufficiently high (i.e., the air pressure is sufficiently low), the diaphragm moves to close the switch contacts, which are connected via an electrical lead 47 to the sequence controller 14. It is arranged that the vacuum switch 45 will close only at a vacuum level which corresponds to the presence of a rivet 32 on the anvil 34 sealing the aperture 35, as previously described. When the presence of a rivet 32 is thus detected at the correct stage, the sequence controller 14 allows the installation apparatus to proceed to the next stage of operation. In practice, moving thus to the next stage may well also require the detection of other parts of the apparatus to be in the correct states or positions.

Detection of the progress of a broken off stem 36*a* along the extraction pipe 31, to a predetermined position 58 which is near the receptacle 15, is achieved by means of a proximity sensor 48. In this example apparatus, the sensor is an inductive sensor, which senses the presence of a metal stem 36 by a change in the electromagnetic inductance. The sensor 48 is mounted immediately against the pipe 31 at the position 58, which is near the receptacle 15. The sensor is held in a bracket 49, through which the pipe 31 also passes, to position the sensor against the pipe 31. The bracket 49 is mounted on the coupling sleeve 42. The presence of a broken off stem 36*a* at the position 58 opposite the sensor 48, as the stem 36*a* passes along the pipe 31, causes the sensor to emit an electrical output. Since the stem is moving along the pipe 31 at high speed, it actuates the sensor for only a very short time. An electrical output of such short duration is insufficient to actuate the electronic/pneumatic sequence controller 14, so there is provided a solid-state latching relay 51 (FIG. 4) in an electrical lead 52 between the proximity sensor 48 and the controller 14. When the sensor 48 detects the passage of a stem 36 and gives an electrical output, this output latches the solid state relay 51 to give an electrical output continuously to the controller 14 until the relay 51 is later reset by a reset pulse applied to it, at an appropriate time, by the controller 14. The reset pulse is applied along a connection indicated by 53 in FIG. 4.

One problem which occurs in practice is that the vacuum-sensitive switch 45 may suffer from hysteresis. That is to say, when it has been closed by the application of a sufficient level of vacuum, and the vacuum level is then reduced again, the switch 45 does not revert to the open position until the vacuum level has fallen to a value substantially below that at which it closes. When a rivet 32 has been installed, the relatively low rate at which atmospheric air can enter the small anvil aperture 35 means that the vacuum level in the receptacle 15 falls relatively slowly. In practice it is found that the vacuum-sensitive switch 45 may not reset to the open position in time for the next cycle of operation of the system. Consequently it is necessary to reset the vacuum-sensitive switch 45 artificially. This is achieved by means of a reset valve 54, which is illustrated schematically in FIG. 6.

The reset valve 54 is arranged in the air tube 46 between the receptacle 15 and the vacuum-sensitive switch 45. It is a three-port valve which is spring-biassed so that it normally connects the air tube 46 directly to the switch 45. The valve 54 is actuated by a solenoid 55 (FIG. 6) to move so as to seal the air tube 46 and connect the vacuum-sensitive switch 45 to atmosphere (i.e., to destroy the vacuum in the switch 45 and immediately reset it to the open condition). The solenoid 55 is connected to the electronic controller **14*a* by an electrical lead 56. When the solenoid 55 is de-actuated, the valve 54 reverts to its normal position, in which the switch 45 is connected to the air tube 46 to detect the level of vacuum in the receptacle 15. The solenoid 55 is actuated by the programmable electronic controller 14*a* so as to reset the vacuum switch 45 only after the proximity sensor 48 has detected the presence of a broken off rivet stem 36*a* at the position 58 that is to say, when a rivet 32 has been installed so that there is no rivet 32 inserted in the anvil aperture 35**.

In practice, resetting of the vacuum-sensitive switch 45 may also require the detection of other parts of the apparatus to be in the correct states or positions. The controller 14 is programmed so that the solenoid 55 is not de-actuated until a suitable later stage of the operation of the system when the vacuum level in the receptacle 15 will have fallen below that value which the vacuum-sensitive switch 45 will detect.

Figure 7:
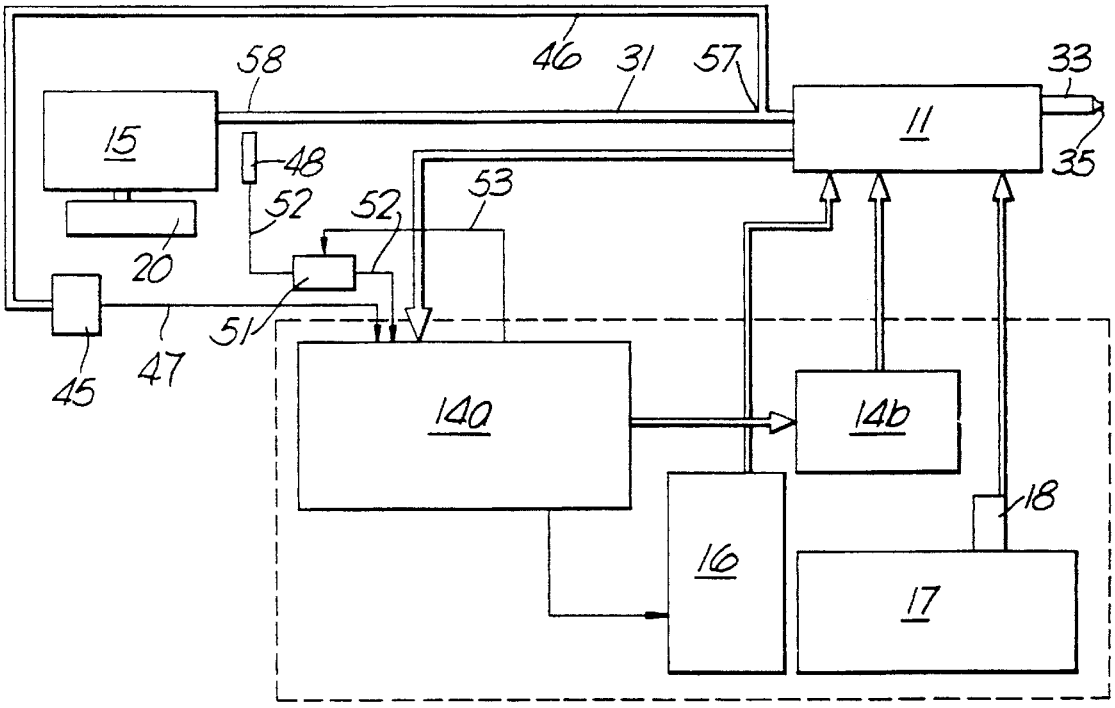
FIG. 7 is similar to FIG. 4 but illustrates a slightly modified system.

FIG. 7 is similar to FIG. 4 but shows a slightly modified system. The vacuum switch 45 used in this modification does not suffer from the hysteresis problem mentioned above, so that it does not need any reset valve 54. Furthermore, the vacuum-level sensing air tube 46 is connected to the stem extracter pipe 31 at a position 57 adjacent the installation apparatus 11 and the aperture 35. It is believed that connection to detect the vacuum level adjacent the aperture 35, at which the presence or absence of a rivet 32 is to be detected, provides a faster and more reliable response of the vacuum switch 45.

The invention is not restricted to the details of the foregoing example.

Attention is drawn to our co-pending application Ser. No. 07/035188 which includes part of the foregoing description, but claims a different invention.

We claim:

1. Fastener installation apparatus for installing fasteners, which comprises:

fastener installation means including an aperture into which part of a fastener to be installed thereby is inserted;

vacuum means, connected to the aperture, for drawing air in through the aperture; and vacuum level detection means communicating with a region subject to a vacuum drawn by said vacuum means for detecting whether the level of vacuum in said region corresponds to the presence of a fastener in the aperture of the installation means.

2. Fastener installation apparatus for installing fasteners which apparatus comprises:

fastener installation means including an aperture into which part of a fastener to be installed thereby is inserted;

a passage connected to the aperture;

vacuum means, connected to the aperture by means of the passage, for drawing air into the aperture;

and vacuum level detection means connected to the passage for detecting whether the level of vacuum corresponds to the presence of a fastener in the aperture of the installation means.

3. Apparatus as claimed in claim 1 or claim 2, in which the flow of air drawn in through the aperture by the vacuum means is used to remove from the fastener installation means portions of fasteners which are broken off at the installation of the fastener.

4. Apparatus as claimed in claim 3, including a receptacle in which broken-off fastener portions are deposited by the air flow.

5. Apparatus as claimed in claim 4, in which the vacuum means draws air out of the receptacle and thus in through the aperture as aforesaid.

6. Apparatus as claimed in claim 4, in which the vacuum level detection means is connected to the receptacle to detect the level of vacuum therein.

7. Apparatus as claimed in claim 1, including a passage connecting the aperture to the vacuum means, in which the vacuum level detection means is connected to the passage at a position adjacent the aperture, to detect the level of vacuum in the passage adjacent the aperture.

8. Apparatus as claimed in claim 1 or 2, arranged to operate cyclically so as to instal a plurality of fasteners successively, including control means operative to allow the cyclical operation of the apparatus to continue, so as to instal a fastener, only upon the vacuum level detection means detecting a level of vacuum corresponding to the presence of the fastener in the aperture of the fastener installation means.

9. Apparatus as claimed in claim 8, including resetting means for resetting the vacuum level detection means, after the latter has detected the presence of a fastener in the aperture, to a state in which it is ready to detect the presence of a further fastener in the aperture, the resetting means being actuated to reset the vacuum level detection means by a signal indicating that the fastener which was in the aperture is no longer there.

10. Fastener installation apparatus as claimed in claim 9, including conveying means for conveying away from the fastener installation means a portion of a fastener which is broken off at the installation of the fastener, and portion detection means for detecting when a broken-off portion has reached a pre-determined position on its journey along the conveying means, in which the resetting means is actuated to reset the vacuum level detection means only upon, at least, the aforesaid broken-off portion detection means detecting the presence at the aforesaid pre-determined position of the broken-off portion of the previously installed fastener.

11. Fastener installation apparatus adapted to operate cyclically so as to instal successively a plurality of fasteners each having a portion which is broken-off at installation, which apparatus comprises:

fastener installation means for installing a fastener and thereby producing a broken-off portion, the fastener installation means including an aperture into which part of the fastener is inserted;

conveying means connected to the installation means for conveying the broken-off portion away from the installation means;

portion detection means associated with the conveying means at a pre-determined position therealong for detecting when the broken-off portion has reached said pre-determined position on its journey along the conveying means;

vacuum means, connected to the aperture, for drawing air in through the aperture;

vacuum level detection means communicating with a region subject to a vacuum drawn by said vacuum means for detecting whether the level of vacuum in said region corresponds to the presence of a fastener in the aperture;

control means operatively connected to said vacuum level detection means and operative to allow the cyclical operation of the apparatus to continue, so as to instal a fastener, only upon the vacuum level detection means detecting a level of vacuum corresponding to the presence of the fastener in the aperture of the fastener installation means; and resetting means connected to both the vacuum level detection means and the portion detection means and operative for resetting the vacuum level detection means after the latter has detected the presence of a fastener in the aperture, to a state in which it is ready to detect the presence of a further fastener in the aperture, the resetting means being actuated to reset the vacuum level detection means only upon, at least, the broken-off portion detection means detecting the presence at the aforesaid pre-determined position of the broken-off portion of the previously installed fastener.

12. Improved apparatus for successively setting separable mandrel rivets of the type including an installation tool for receiving rivets in a gripping and tensioning mechanism at an apertured receiving end of the tool, and ejecting separated mandrels; a rivet presentation assembly for successively delivering mandrel rivets from a supply to the gripping and tensioning mechanism of the installation tool; and a mandrel collection assembly for drawing separated mandrels from the tool and routing these to a remote receptacle; wherein the mandrel collection assembly incorporates a channel under negative pressure connecting the installation tool to the remote receptacle; wherein the improvement comprises:

first means for monitoring the delivery of mandrel rivets to the installation tool, said first monitoring means comprising pressure sensor means for recognizing a predetermined negative pressure condition in said mandrel collection system indicative of the presence of a mandrel rivet at the gripping and tensioning mechanism and outputting signals indicating the presence or absence of a rivet;

second means for monitoring the exiting of separated mandrels from the tool, said second monitoring means comprising means for sensing the passage of a spent mandrel through the channel of the mandrel collection assembly and outputting a "mandrel sensed" signal in such event; and processor means responsive to the signals from the first and second monitoring means, for controlling the operation of said rivet setting apparatus.

13. An apparatus as defined in claim 12, wherein the rivet presentation assembly comprises a transfer means having a retracted position for receiving a mandrel rivet and an advanced position for aligning said rivet with the apertured end of said installation tool and inserting the rivet to the gripping and tensioning means, wherein the processor means is additionally responsive to the retracted and advanced positions of said transfer means.

14. Apparatus as defined in claim 13 wherein the processor means is responsive to the retracted and advanced positions of said transfer means to command the delivery of a rivet to the transfer means, and the insertion of a rivet into the installation tool, respectively.

15. Apparatus as defined in claim 12 wherein the second monitoring means comprises a proximity sensor located adjacent the channel of the mandrel collection assembly.

16. Apparatus as defined in claim 12 wherein the first monitoring means comprises a vacuum transducer coupled to the mandrel collection assembly channel.

17. Apparatus as defined in claim 12 wherein the processor means produces command signals in response to the signals from the first and second monitoring means, further comprising at least one solenoid valve responsive to command signals for fluidically actuating a mechanism of such apparatus.

18. Apparatus as defined in claim 12 further comprising means for reciprocating the installation tool between retracted and advanced positions, and means for sensing the separation of a mandrel and providing a "mandrel separated" signal to the reciprocating means in such event, wherein the reciprocating means is responsive to the "mandrel separated" signal to move the tool to its retracted position.

19. Apparatus as defined in claim 12 further comprising means for reciprocating the installation tool between advanced and retracted positions, said reciprocating means being responsive to the rivet present signal from the first monitoring means to move the signal to its advanced position.

20. In an apparatus for successively installing mandrel rivets, of the type including a rivet installation tool having a setting mechanism for receiving rivets and installing them in workpieces, and rivet presentation means for successively delivering rivets from a supply to the rivet installation tool for installation, said rivet presentation means including a transfer device for successively receiving and retaining rivets from the supply at a first position removed from the location of the workpieces, transporting the retained rivets in a predetermined orientation to a second position proximate the setting mechanism, and inserting rivets into the setting mechanism, a plurality of mechanisms of said rivet installation apparatus being moved by fluidic drives, at least one pressure sensor for detecting a predetermined pressure condition within said installation apparatus, and producing an output signal in such event, a plurality of electronically actuated valves for actuating corresponding fluidic drives in response to command signals, and control means for producing one of said command signals in response to a predetermined output signal from said at least one pressure sensor.

21. Apparatus as defined in claim 20 wherein the fluidic drives are pneumatic drives, and at least one of the electronically actuated valves is a solenoid valve.

22. Apparatus as defined in claim 20 wherein the at least one pressure sensor comprises means for detecting the presence of a rivet in the application tool and producing a "rivet present" output signal, wherein the control means produces a command signal causing motion of the transfer device from its first to its second position in response to the "rivet present" output signal.

23. Apparatus as defined in claim 20 wherein the control means causes delivery of a rivet to the transfer device when the transfer device moves to its first position.

24. Apparatus as defined in claim 20 further comprising means for inserting as rivet from the transfer device into the setting mechanism, wherein the control means produces a command signal to said inserting means when the transfer device moves to its second position.

25. A method for installing mandrel rivets using a rivet installation tool having a nosepiece for receiving rivets, a setting mechanism within the nose piece for setting the rivets into workpieces and breaking of the mandrels, and further using an automated rivet presentation assembly for successively delivering rivets from a supply to the nosepiece, and a mandrel collection assembly having a channel under vacuum for routing broken off mandrels from said tool, comprising the steps of:

attempting to deliver a rivet from a bulk supply to the setting mechanism;

automatically monitoring the presence or absence of a rivet at the setting mechanism, and in response thereto signaling whether or not a rivet has been received; and in response to a signal indicating a rivet has been received, allowing the rivet installation tool to proceed to the next stage of operation.

26. A method as defined in claim 25, wherein the delivery step comprises the sequential steps of transporting a rivet to a position and orientation aligned with the setting mechanism, and inserting said rivet from such position into the setting mechanism.

27. A method as defined in claim 25, wherein the presence or absence of a rivet at the setting mechanism is monitored by detecting the internal pressure within the mandrel collection assembly.

28. A method as defined in claim 25, further comprising the steps of sensing the exiting of a broken off mandrel from the installation tool, and in response thereto causing the rivet presentation assembly to deliver a new rivet to the setting mechanism.

29. A method for installing mandrel rivets using a rivet installation tool having a nosepiece for receiving rivets, a setting mechanism within the nosepiece for setting the rivets into workpieces and breaking of the mandrel, and further using an automated rivet presentation assembly for successively delivering rivets from a supply to the nosepiece, a mandrel collection assembly for routing broken off mandrels from said tool, and a tool reciprocating device for moving the tool between a retracted position wherein it receives rivets from the rivet presentation assembly and an advanced position where it sets rivets into workpieces, comprising the steps of:

sensing the presence of a rivet within the nosepiece using a first sensor and in response to a signal from said first sensor to said tool reciprocating device, causing the tool to move from its retracted position to its advanced position; and sensing the breaking off of a mandrel within the tool using a second sensor and in response to a signal from said second sensor to said tool reciprocating device, causing the tool to move from its advanced position to its retracted position.

* * * * *